US007981468B2

(12) United States Patent
Blair et al.

(10) Patent No.: US 7,981,468 B2
(45) Date of Patent: Jul. 19, 2011

(54) FLUIDICS COATING APPARATUS AND METHOD FOR SURFACE TREATING OF TONER AND DRY INKS

(75) Inventors: Stewart W. Blair, Rochester, NY (US); Tomas G. P. McHugh, Webster, NY (US); Greg Munro, Aberdeen (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/618,838

(22) Filed: Nov. 16, 2009

(65) Prior Publication Data

US 2010/0055306 A1 Mar. 4, 2010

Related U.S. Application Data

(62) Division of application No. 10/967,993, filed on Oct. 19, 2004, now Pat. No. 7,674,032.

(51) Int. Cl.
*B05D 3/04* (2006.01)
*B05D 7/00* (2006.01)

(52) U.S. Cl. ..... 427/213; 427/240; 422/124; 422/139; 366/165.1

(58) Field of Classification Search ..... 366/165.1, 366/165.2, 165.3, 165.4, 165.5; 427/213, 427/240; 422/124, 139
See application file for complete search history.

(56) References Cited

U.S. PATENT DOCUMENTS

| | | | | | |
|---|---|---|---|---|---|
| 3,219,420 | A | * | 11/1965 | Dielenberg | 422/145 |
| 4,053,142 | A | * | 10/1977 | Johannes | 366/165.1 |
| 4,461,742 | A | * | 7/1984 | Rowe et al. | 422/129 |
| 4,532,155 | A | * | 7/1985 | Golant et al. | 427/213 |
| 4,592,302 | A | * | 6/1986 | Motoyama et al. | 118/303 |
| 4,746,547 | A | * | 5/1988 | Brown et al. | 427/213 |
| 5,075,138 | A | * | 12/1991 | Tanaka et al. | 427/213 |
| 5,096,744 | A | * | 3/1992 | Takei et al. | 427/213 |
| 2010/0055306 | A1 | * | 3/2010 | Blair et al. | 427/212 |

FOREIGN PATENT DOCUMENTS

GB 2357050 10/2003

* cited by examiner

*Primary Examiner* — Tony G Soohoo
(74) *Attorney, Agent, or Firm* — Donna P. Suchy; Christopher J. White

(57) ABSTRACT

An apparatus (10) for surface treating particulate material (M) with surface treatment particles (S) includes a substantially cylindrical body (12) having a top (18), bottom (16) and sidewall (14). A mixing chamber (42) is defined within the body (12). At least one injector inlet (36) and at least one process air inlet (32) are in communication with the mixing chamber (42). At least one outlet (34) is in fluid communication with the mixing chamber (42).

10 Claims, 5 Drawing Sheets

FLUIDICS COATING APPARATUS AND METHOD FOR SURFACE TREATING OF TONER AND DRY INKS

CROSS REFERENCE TO RELATED APPLICATIONS

This application is a divisional of prior U.S. patent application Ser. No. 10/967,993 filed Oct. 19, 2004, now issued as U.S. Pat. No. 7,674,032, which is hereby incorporated by reference in its entirety.

FIELD OF THE INVENTION

The present invention relates to the surface treatment of fine particulate material, such as toner and dry ink used in electrophotographic printing machines and other fine particulate material.

BACKGROUND OF THE INVENTION

The toner and/or dry ink used in electrophotographic printing machines is a blend of materials, including plastic resins, coloring pigments and other ingredients. Most toners are produced in bulk using a melt mixing or hot compounding process. Plastic resins, carbon black, magnetic iron oxides, waxes and charge control agents are blended together while in a molten state to thereby form a hot paste. This mixture is then cooled, typically by forming it into slabs on a cooling belt or by pelletizing the mixture and cooling the pellets. The toner pellets are then ground or pulverized into a toner powder by, for example, jet mills or air-swept hammer mills. This process produces a powder having a wide range of particle sizes. The toner powder is then sifted or classified to remove over-size and under-size toner particles. Most toner powders produced today for use in electrophotographic printing processes have a volume-median particle size of from approximately 4 to approximately 14 microns.

The toner powder may then be surface treated with various additives, such as, for example, silica and charge control agents, in order to adjust various characteristics of the toner powder, such as the flow and electrostatic properties thereof The additives are in the form of particles of a super-fine particle size, such as, for example, a volume median particle size in the sub-micron or nanometer range. Surface treatment of particulate material occurs or can be characterized along a continuum. More particularly, and with reference to FIG. 1, the degree to which a particulate material, such as a toner particle, is treated with surface treatment particles, such as silicon dioxide ($SiO_2$), varies from a poorly dispersed condition wherein just a few surface treatment particles are clumped into adherence with the particulate material (illustrated at the far left-hand side of the continuum of FIG. 1) to an engulfed condition wherein the surface treatment particles are relatively-evenly dispersed on the outer surface of the particulate material with at least fifty-percent of their surface area being below or embedded within the surface of the particulate material (illustrated at the far right-hand side of the continuum of FIG. 1).

Conventionally, surface treatment of fine particulate material such as toner is accomplished by mechanically mixing the toner powder and additives together in a high-speed high-capacity paddle-type mixer, such as those manufactured by Hosokawa Micron Group and Henschel. Such mixers conduct a batch mixing process whereby a relatively large quantity, such as, for example, 75 to 1000 kilograms, of toner powder is surface treated. The general disadvantages of batch processes, i.e., their discontinuous and labor intensive nature, are well known. Further, the large quantity of particulate material involved in a batch process dictates that large machines be used. Large machines, in turn, take up valuable floor space within a manufacturing facility and are more difficult to clean and maintain than smaller machines. Still further, the large quantity of particulate material involved in a batch process may result in a significant amount of particulate material entering the air stream and which may undesirably form a potentially explosive cloud of particulate matter. Moreover, the conventional method of surface treating particulate material requires relatively long mixing times in order to achieve a significant degree of surface treatment. Thus, surface treatment of particulate material using conventional methods is a time consuming and relatively inefficient process.

Therefore, what is needed in the art is an improved apparatus and method for surface treating fine particulate material.

Furthermore, what is needed in the art is a continuous, rather than a batch, process for surface treating fine particulate material.

Still further, what is needed in the art is an apparatus and method for surface treating fine particulate material that processes smaller quantities of material in a continuous manner and can therefore be conducted on a smaller scale, with smaller machines that are easier to maintain and clean, and which substantially reduce the likelihood of potentially explosive conditions.

Moreover, what is needed in the art is an apparatus and method for surface treating fine particulate material that achieve a relatively high amount of surface treatment in an efficient manner.

SUMMARY OF THE INVENTION

The present invention provides an apparatus for surface treating particulate material with surface treatment particles.

The invention comprises, in one form thereof, a substantially cylindrical body (12) having a top (18), bottom (16) and sidewall (14). A mixing chamber (42) is defined within the body (12). At least one injector inlet (36) and at least one process air inlet (32) are in communication with the mixing chamber (42). At least one outlet (34) is in fluid communication with the mixing chamber (42).

An advantage of the present invention is that surface treatment is accomplished using an in-line and continuous process rather than a batch process.

Yet another advantage of the present invention is that tacking and embedment of the surface treatment particles onto/into the surface of the particulate material is accomplished.

Still another advantage of the present invention is that it is compact and has no moving parts.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE DRAWINGS

Figure 1:
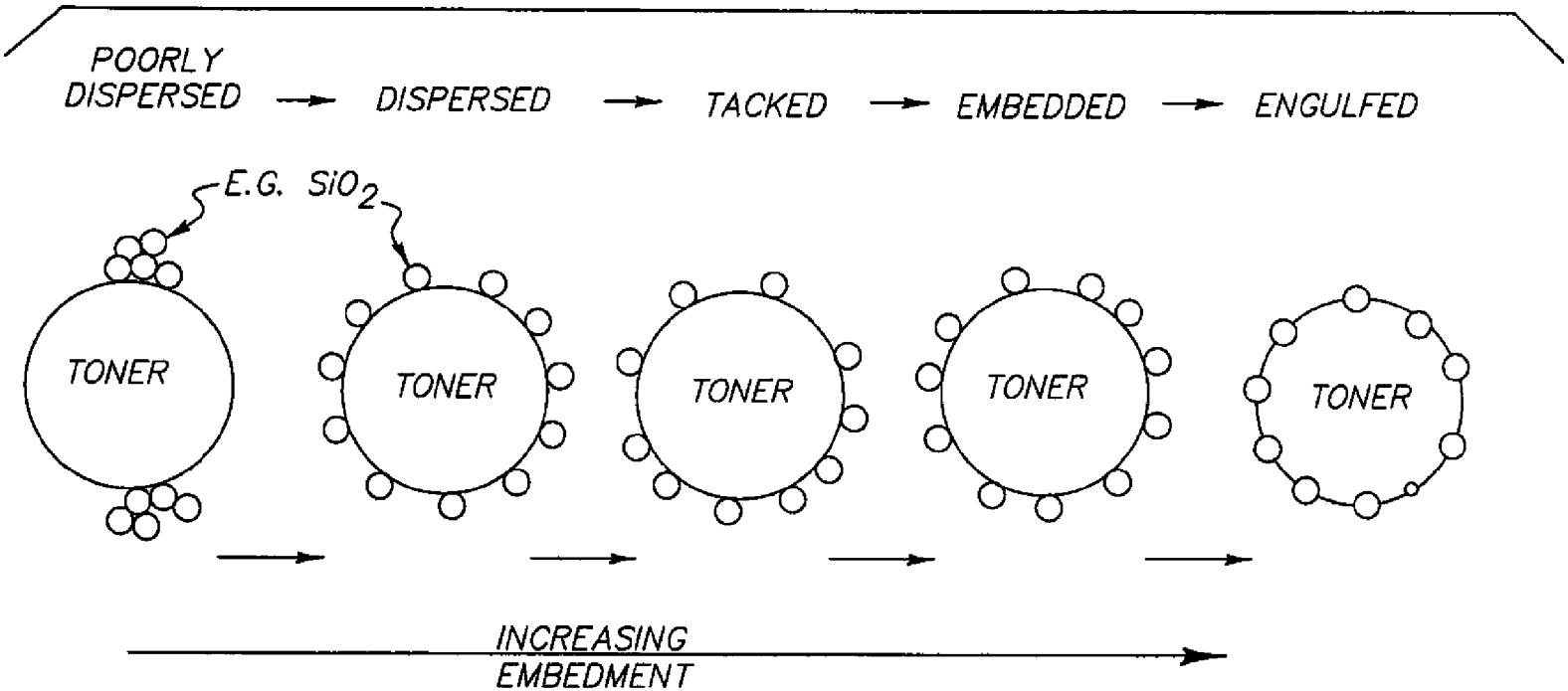
FIG. 1 illustrates the continuum along which surface treatment of a particulate material occurs and/or is characterized.
Figure 2:
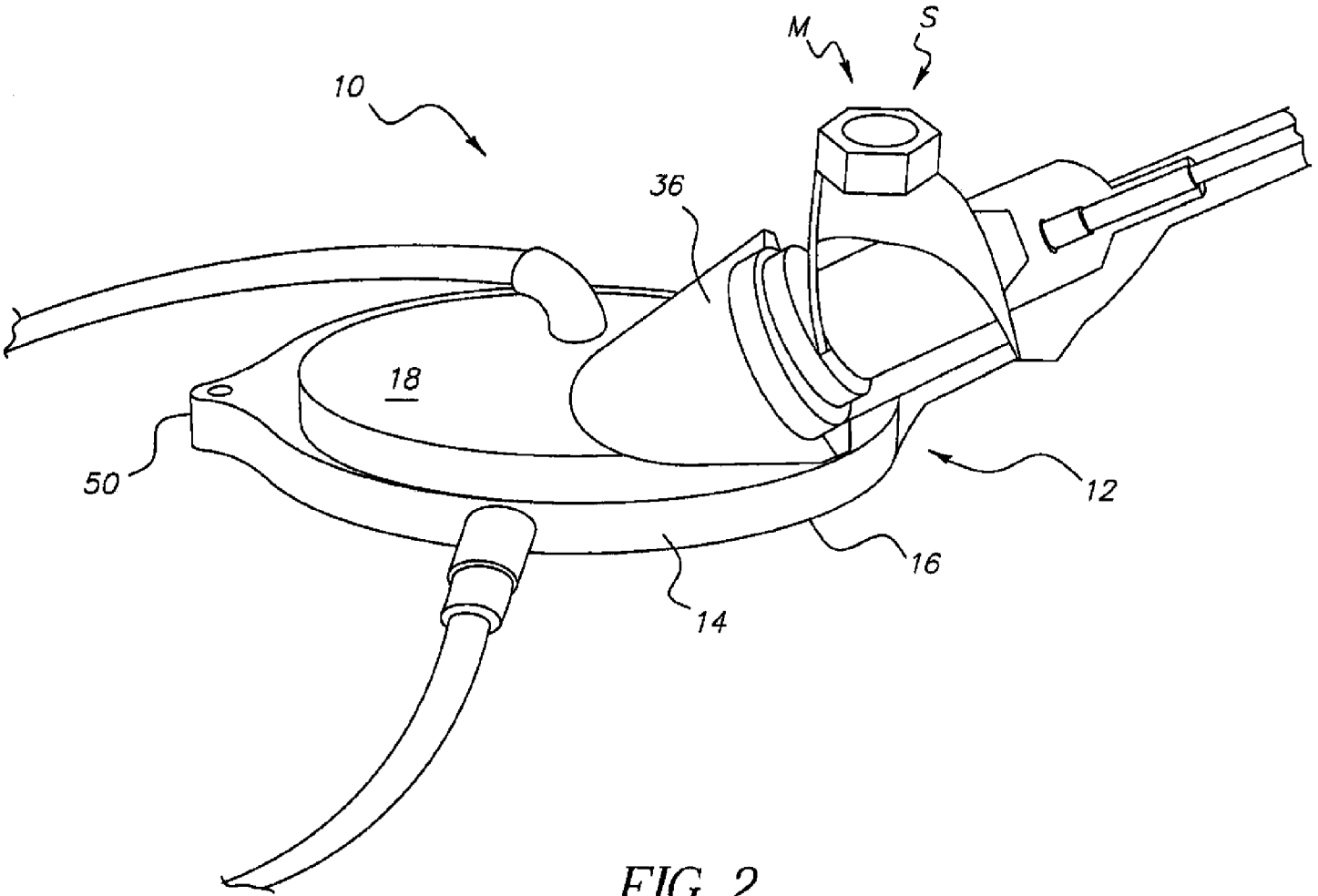
FIG. 2 is a perspective view of one embodiment of a fluidics coating device of the present invention.
Figure 3:
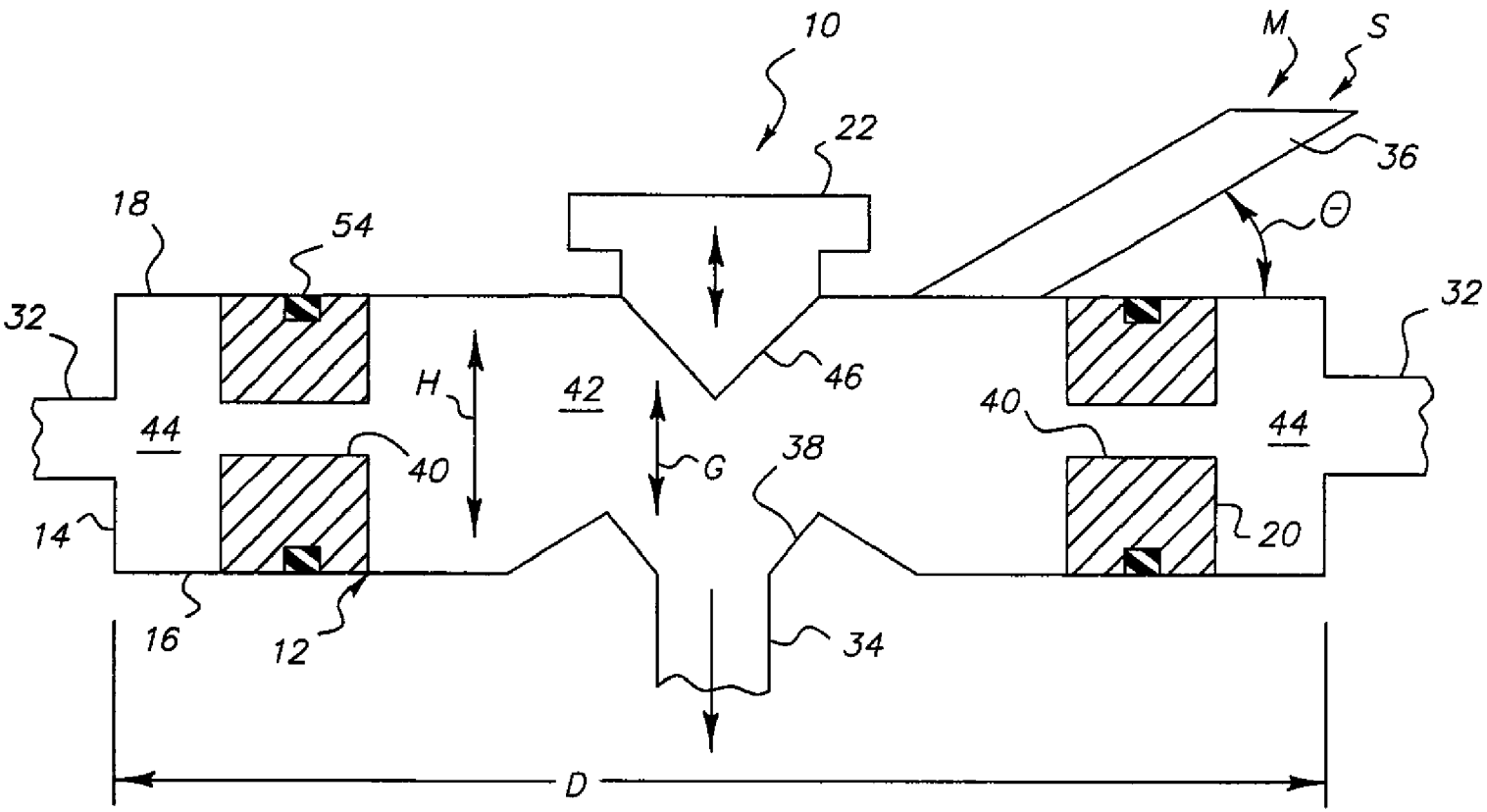
FIG. 3 is a cross-sectional view of the fluidics coating device of FIG. 2.

Referring now to the drawings, and particularly to FIGS. 2 and 3, there is shown one embodiment of a fluidics coating device (FCD) of the present invention. Generally, particulate material M and surface treatment particles S are introduced into FCD 10 wherein the particles collide with each other under controlled conditions thereby coating the particulate material M with the smaller surface treatment particles S.

Particulate material M is a fine particulate or powder material, such as, for example, toner, carbon, silica, alumina, titanium dioxide, talc, plastic resins, and other powdered materials. Surface treatment particles S are also fine particulate materials, such as, for example, silica, titanium dioxide, and cerium oxide, and are typically at least an order of magnitude smaller in particle size than particulate material M.

FCD 10 includes cylindrical body 12 having a sidewall 14, bottom 16, top 18. FCD 10 further includes, as is more particularly described hereinafter, nozzle ring 20 and outlet adjusting means 22. Generally, particulate material M, such as, for example, toner, and surface treatment particles S, such as, for example, $SiO_2$, are carried by a flow of pressurized air, or another pressurized gas such as nitrogen, and are thereby injected into FCD 10 wherein the particles S and M are mixed together and caused to collide to thereby coat the outer surface of the particulate material M with the surface treatment particles S.

Body 12 is generally cylindrical in shape, and defines therein at least one process air inlet 32, outlet orifice 34 and at least one injector inlet 36. Injector inlet 36 forms an inlet angle θ with top 18, as is more particularly described hereinafter. Particulate material M and surface treatment particles S are injected into mixing chamber at inlet angle θ.

Outlet orifice 34 includes an inlet portion 38 that is generally frustoconical in shape. Body 12 is constructed of a material, such as, for example, steel or other material, that is suitable for use under and capable of withstanding conditions of relatively high pressure and which is abrasion resistant.

Nozzle ring 20 is generally parallel with and spaced apart in a radially-inward direction from sidewall 14, and sealingly engages bottom 16 and top 18. Nozzle ring 20 defines a plurality of nozzles 40 that extend therethrough in a generally-radial direction. Each of nozzles 40 is skewed by a predetermined angle Ø (FIG. 5), such as, for example, approximately thirty to forty-five degrees relative to a purely radial direction, dependent upon their circumferential positions to promote and achieve a centrifugal flow of air and particles within mixing chamber 42.

Mixing chamber 42 is defined radially inward of nozzle ring 20, i.e., the area between nozzle ring 20 and the portions of bottom 16 and top 18 surrounded thereby and/or contained therein. Air flow chamber 44 is defined by the area radially outside of nozzle ring 20, i.e., the area between nozzle ring 20, sidewall 14 and the portions of bottom 16 and top 18 that are radially outside of nozzle ring 20. Process air inlets 32 provide pressurized process air to air flow chamber 44, and nozzles 40 fluidly connect air flow chamber 44 with mixing chamber 42. Mixing chamber 42 has a predetermined diameter D and height H.

Outlet adjusting means 22, such as, for example, a machined bolt, threadingly engages and extends through an orifice or opening (not referenced) in top 18 of body 12. Outlet adjusting means 22 includes an inner end portion 46 and is axially aligned in a substantially concentric manner with outlet orifice 34. Inner end portion 46 is frustoconical in shape and is complementary to inlet portion 38 of outlet orifice 34. Outlet adjusting means 22 is translatable in an axial direction toward and away from inlet portion 38 and/or outlet orifice 34. Inner end portion 46 and inlet portion 38 form therebetween an outlet gap G through which surface-coated particulate material exits FCD 10.

Figure 4:
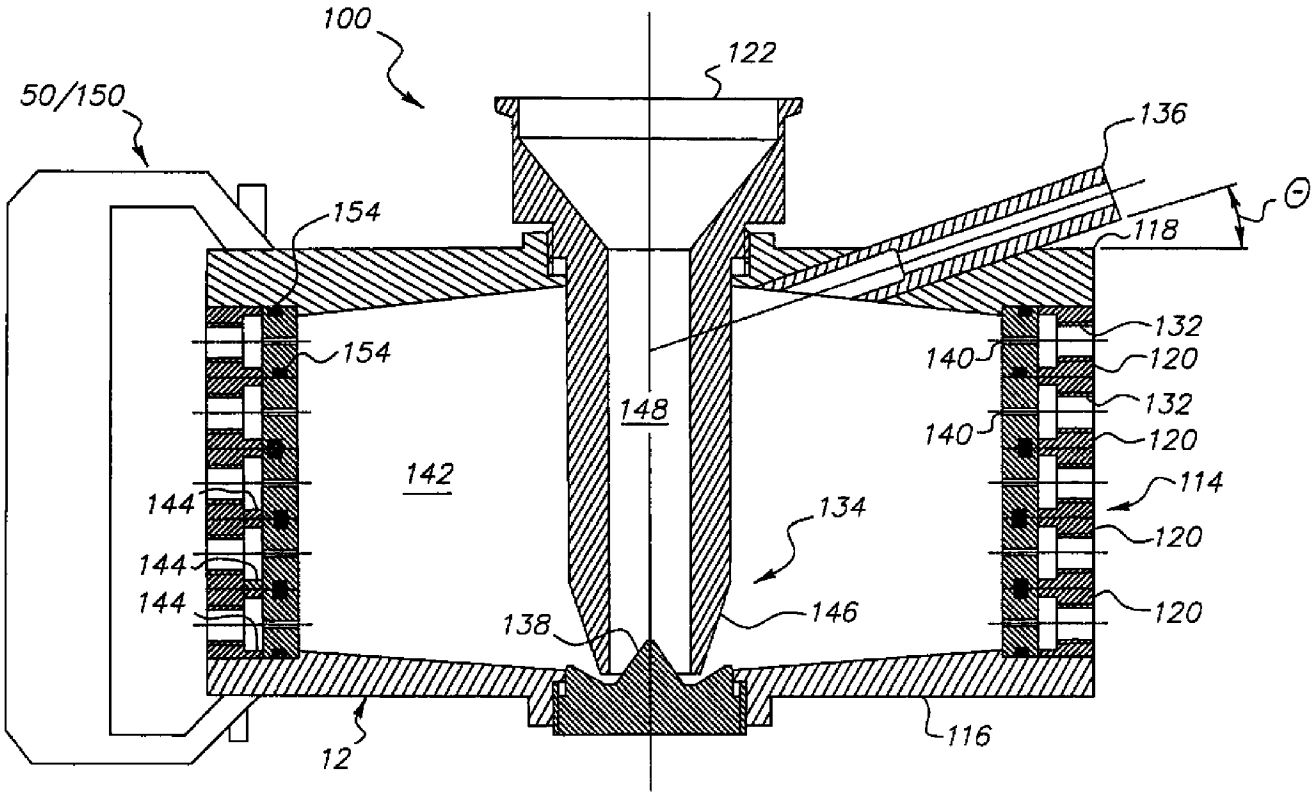
FIG. 4 is a cross-sectional view of a second embodiment of a fluidics coating device of the present invention.

Sidewall 14 and bottom 16 are integral with each other, and top 18 is coupled thereto by one or more clamping mechanism 50 (FIGS. 2 and 4). Sidewall 14 includes at least one gasket or sealing member (not shown) to ensure a sealing engagement between sidewall 14 and top 18, and similarly nozzle ring 20 includes at least one gasket or sealing member 54 to ensure a sealing engagement with bottom 16 and top 18.

Referring now to FIG. 4, a second embodiment of a fluidics coating device (FCD) of the present invention is shown. FCD 100 is, in some respects, generally similar to FCD 10 and therefore the discussion to follow concentrates on the distinctions of FCD 100 relative to FCD 10. FCD 100 includes cylindrical body 112 having a sidewall 114, bottom 116 and top 118. Body 112 is generally cylindrical in shape and includes an outlet assembly 134. Body 112 defines therein at least one injector inlet 136. Injector inlet 136 of FCD 100, much like FCD 10, forms an angle θ with top 118. Outlet 134 is more particularly described hereinafter. Body 112 is constructed of a material, such as, for example, steel or other material, that is suitable for use under and capable of withstanding conditions of relatively high pressure and which is abrasion resistant.

Sidewall 114 is comprised of a plurality of stacked nozzle rings 120. Nozzle rings 120 are substantially cylindrical members each of which defines therein at least one process air inlet 132. Each nozzle ring 120 defines a plurality of nozzles 140 that extend therethrough in a generally-radial direction. Each of nozzles 140 is, as discussed above in regard to FCD 10, skewed by a predetermined angle Ø (FIG. 5), such as, for example, approximately thirty to forty-five degrees relative to a purely radial direction, dependent upon their circumferential positions to promote and achieve a centrifugal flow of air and particles within mixing chamber 142.

Mixing chamber 142 is defined radially inward of the plurality of stacked nozzle rings 120 that make up sidewall 114. A respective air flow chamber 144 is defined within each of nozzle rings 120. Each process air inlet 132 provides pressurized process air to a corresponding air flow chamber 144, and nozzles 140 fluidly connect each air flow chamber 144 with mixing chamber 142.

Outlet 134 of FCD 100, in contrast to outlet 34 of FCD 10, is conjunctively formed by inlet portion 138 and outlet adjusting means 122. Inlet portion 138 is associated with, affixed to and/or integral with bottom 116 and is generally frustoconical in shape. Outlet adjusting means 122, such as, for example, a machined bolt, treadingly engages and extends through an orifice or opening (not referenced) in top 118 of body 112 into mixing chamber 142. Outlet adjusting means 122 includes an inner end portion 146 that is axially aligned in a substantially concentric manner with inlet portion 138. Inner end portion 146 is dimensioned to receive therein at least a portion of frustoconical-shaped inlet portion 138.

Outlet adjusting means 122, in contrast to outlet adjusting means 22 of FCD 10, is a hollow threaded member that defines outlet passage 148 therein. Outlet adjusting means 122 is adjusted in an axial direction to thereby move end portion 146 toward and/or away from inlet portion 138 thereby disposing more or less of inlet portion 138 within outlet passage 148 to open and/or close and/or otherwise adjust the area of the opening to outlet passage 148 that is defined by the clearance, if any, between inner end portion 146 and inlet portion 138. Nozzle rings 120, bottom 116 and top 118 are separate structural members which are coupled together by one or more clamping mechanism 150. Each nozzle ring 120 includes at least one gasket or sealing member 154 on each of its interfacial surfaces to ensure a sealing engagement between each of the nozzle rings 120 and between nozzle rings 120 and bottom 116 and/or top 118.

In use, FCD 10 and FCD 100 operate in a substantially similar manner, and the following discussion of the operation of FCD 10 applies equally to FCD 100, except where noted otherwise.

Figure 5:
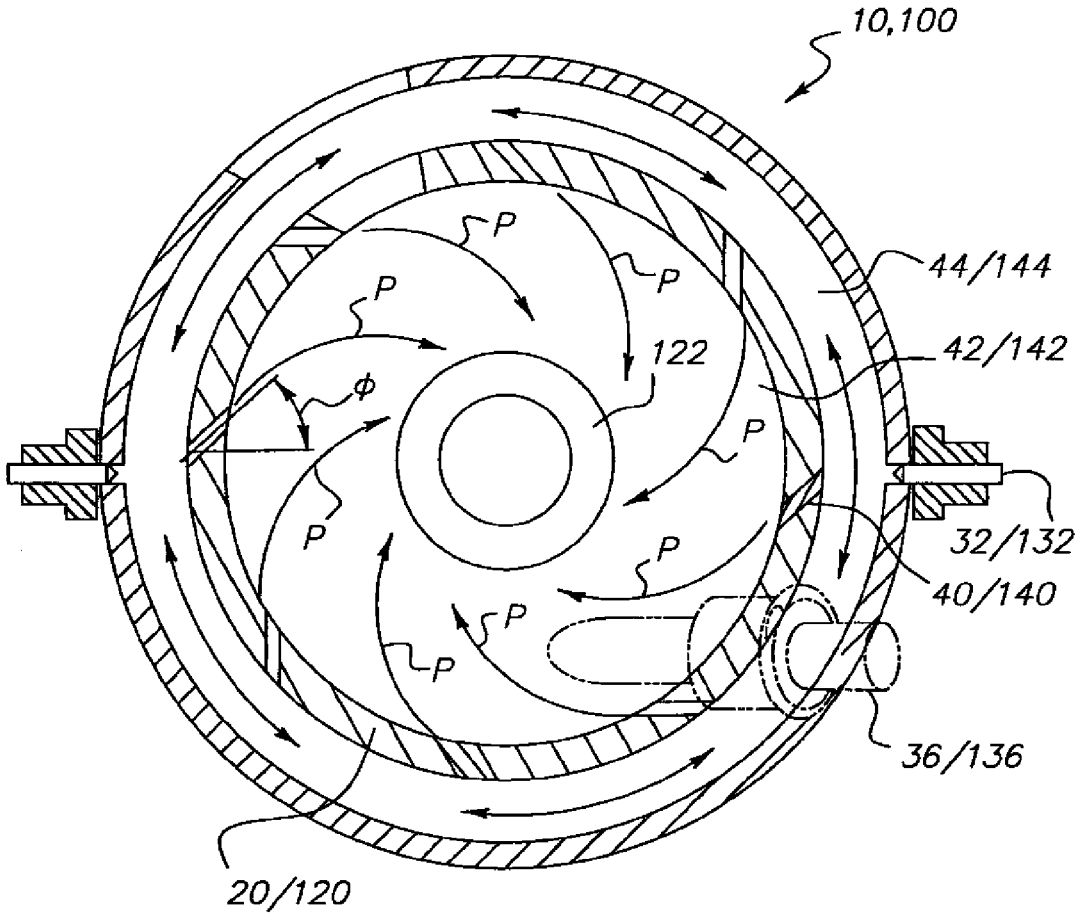
FIG. 5 illustrates the flow of fluids, particulate material, and surface treatment particles into, through and out of the fluidics coating device of FIG. 2.

Process air inlet 32 of FCD 10 is connected to a supply of pressurized process air. The pressurized process air flows into and through process air inlet 32 at a pressure of from approximately 0.1 to approximately 5.4 bar, and preferably from approximately 0.2 to approximately 2.5 bar. The process air flows into air flow chamber 44, through nozzles 40 defined in nozzle ring 22, and into mixing chamber 42. As best shown in FIG. 5, a centrifugal flow of process air as indicated by arrows P within mixing chamber 42 is established by the above-described configuration of nozzles 40. A supply of pressurized air is also supplied to injector inlet 36 at a pressure of from approximately 0.5 to approximately 6 bar, and preferably from approximately 0.7 to approximately 3.0 bar. The process air flowing through process air inlet 32 and through injector inlet 36 is at a temperature of from approximately 10 to approximately 80 degrees Celsius, and preferably from approximately 10 to approximately 50 degrees Celsius, in order to achieve a desired degree of embedment.

The flow of air through injector inlet 32 draws and/or carries with it a predetermined amount of particulate material M and surface treating particles S into the centrifugal flow of process air within mixing chamber 42, wherein the particles collide with each other under predetermined conditions resulting in the coating of the particles of particulate material M with particles of surface treating particles S. The rate of flow of particulate material M and surface treating particles S into mixing chamber 42 (i.e., the feed rate) is from approximately 10 to approximately 240 kilograms per hour.

The particulate material M and surface treating particles S enter mixing chamber 42 through injector inlet 36 and, thus, at angle θ. Angle θ is from approximately twenty to approximately forty-five degrees relative to a horizontal plane that is generally parallel relative to top 18. Angle θ is established so as to avoid impinging particulate material M and surface treating particles S onto the bottom 18 of FCD 10 thus reducing fracturing of the particles and, thereby, the generation of undesirable fine and super fine particles that are difficult to classify and/or separate from finished product.

Mixing chamber 42 of FCD 10 has a predetermined and fixed diameter D and height H. Diameter D is fixed and is from approximately six to approximately twenty-four inches. The height H of mixing chamber 142 of FCD 100, however, is adjustable by adding and/or removing nozzle rings 120 from FCD 100.

Outlet adjusting means 22 is adjusted to form an outlet gap G of from approximately 1 to approximately 20 millimeters. Outlet gap G determines, at least in part, the duration for which particulate material M and surface treating particles S remain within mixing chamber 42. That duration is also typically referred to as the residence time, i.e., the time during which particulate material M remains resident within mixing chamber 42.

A further embodiment of the apparatus of the present invention includes the injection of a liquid additive into mixing chamber 42 where the liquid additive mixes with particulate material M, either in place of or together with surface treating particles S. Introducing the liquid additive into mixing chamber 42 coats particulate material M with the liquid additive and modifies the surfaces of particulate material M through desired chemical reaction(s) with the liquid additive.

A still further embodiment of the present invention includes the injection of a gaseous additive into mixing chamber 42 where it mixes with particulate material M, either in place of or together with surface treating particles S. Introducing the gaseous additive facilitates and/or promotes the chemical reaction and/or physical modification of the surfaces of particulate material M.

It should be particularly noted that the relative humidity of the air within mixing chamber 42, i.e., the process air passing into mixing chamber 42 through inlet 32 and/or the injector air passing through inlet 36, is preferably controlled to a level of from approximately 5% to approximately 100% relative humidity.

While this invention has been described as having a preferred design, the present invention can be further modified within the spirit and scope of this disclosure. This application is therefore intended to cover any variations, uses, or adaptations of the present invention using the general principles disclosed herein.

PARTS LIST

| PARTS LIST | |
|---|---|
| 10. | Apparatus |
| 12. | Body |
| 14. | Sidewall |
| 16. | Bottom |
| 18. | Top |
| 20. | Nozzle Ring |
| 22. | Adjusting Means |
| 32. | Process Air Inlet |
| 34. | Outlet Orifice |
| 36. | Injector Inlet |
| 38. | Inlet Portion |
| 40. | Nozzles |
| 42. | Mixing Chamber |
| 44. | Air flow chamber |
| 46. | Inner end |
| 50. | Clamping Mechanism |
| 54. | Gasket |
| 100. | Apparatus |
| 112. | Body |
| 114. | Sidewall |
| 116. | Bottom |
| 118. | Top |
| 120. | Nozzle Ring |
| 122. | Adjusting Means |
| 132. | Process Air Inlet |
| 134. | Outlet Assembly |
| 136. | Injector Inlet |
| 138. | Inlet Portion |
| 140. | Nozzles |

-continued

| PARTS LIST | |
|---|---|
| 142. | Mixing Chamber |
| 144. | Air flow chamber |
| 146. | Inner end |
| 150. | Clamping Mechanism |
| 154. | Gasket |

θ—Inlet Angle
Ø—Nozzle Angle
S—Surface Treatment Particles
M—Particulate Material
D—diameter
H—height
G—gap

What is claimed is:

1. A method of treating the surface of particles of a particulate matter with surface treating particles, comprising:

providing an airflow chamber and a mixing chamber, the chambers being connected by a plurality of nozzles arranged around the perimeter of the mixing chamber, each of the nozzles being skewed relative to a radial direction;

introducing a flow of pressurized process air into the airflow chamber so that process air flows through the nozzles into the mixing chamber to create a centrifugal flow of pressurized process air therein;

combining particulate matter and surface treating particles;

injecting the combined particulate matter and surface treating particles into the mixing chamber, the mixture being carried by an injection flow of pressurized air;

adjusting an outlet means to vary an output gap to have a selected open area, so that the residence time of the combination within the mixing chamber is controlled to achieve a desired level of embedment of the surface treatment particles in the particulate matter.

2. The method of claim 1, wherein the pressurized process air is introduced to the mixing chamber at a pressure of from approximately 1.0 to approximately 5.4 bar.

3. The method of claim 1, wherein the pressurized process air is introduced to the mixing chamber at a pressure of from approximately 1.0 to approximately 2.5 bar.

4. The method of claim 1, wherein the flow of pressurized air carrying at least one of said surface treating particles and said particulate matter is at a pressure of from approximately 0.5 to approximately 6 bar.

5. The method of claim 1, wherein the flow of pressurized air carrying at least one of said surface treating particles and said particulate matter is at a pressure of from approximately 0.5 to approximately 2.0 bar.

6. The method of claim 1 wherein the particulate matter and the surface treating particles are injected at an angle so that they are entrained in the centrifugal airflow and do not impinge particulate matter and surface treating particles onto a wall, top or bottom of said mixing chamber.

7. The method of claim 1, wherein said particulate matter and said surface treating particles are injected at an angle of from approximately twenty to approximately forty-five degrees relative to a horizontal plane.

8. The method of claim 1, wherein said injecting steps comprise a single injecting step wherein the same flow of pressurized air carries both the particulate matter and the surface treating particles into the mixing chamber.

9. The method of claim 1, wherein the flow of pressurized process air and the flow of pressurized air injecting the particulate matter into the mixing chamber is from approximately 10 to approximately 50 degrees Celsius.

10. The method of claim 1, wherein the operating step includes adjusting the position of an inlet portion and of an adjustable end portion of the outlet orifice to provide the selected open area.

* * * * *